United States Patent [19]

Benjamin

[11] 3,991,731

[45] Nov. 16, 1976

[54] CHARGE FORMING DEVICE

[75] Inventor: Benjamin C. Benjamin, Flint, Mich.

[73] Assignee: Schmelzer Corporation, Durand, Mich.

[22] Filed: June 21, 1974

[21] Appl. No.: 481,481

[52] U.S. Cl. ..... 123/119 F; 261/39 B
[51] Int. Cl.[2] ..... F02M 1/10; F02M 1/08
[58] Field of Search ..... 123/119 F, 117 A; 261/39 R, 39 B

[56] References Cited

UNITED STATES PATENTS

| | | | |
|---|---|---|---|
| 2,481,259 | 9/1949 | Taylor | 123/119 F |
| 2,979,047 | 4/1961 | Rapplean et al. | 123/119 F |
| 3,014,471 | 12/1961 | Eiler | 123/119 F |
| 3,486,742 | 12/1969 | Szwargulski | 261/39 B |
| 3,606,871 | 9/1971 | Gropp et al. | 123/117 A |
| 3,773,023 | 11/1973 | Taylor | 123/119 F |
| 3,831,567 | 8/1974 | Freismuth et al. | 123/119 F |

*Primary Examiner*—Charles J. Myhre
*Assistant Examiner*—James D. Liles
*Attorney, Agent, or Firm*—Fisher, Gerhardt & Groh

[57] ABSTRACT

A carburetor has a choke control device that acts in connection with a thermoplastic control to permit the carburetor choke valve to be closed during starting but provides a controlled gradual opening of the choke valve after starting. The device includes a self-cleaning purge feature for continual cleaning of the device. A simple one way choke valve device and precision by-pass give exact control of the choke opening. A back pressure valve is provided to prevent back fire damage to the unit.

16 Claims, 3 Drawing Figures

CHARGE FORMING DEVICE

The present invention relates to charge forming devices for internal combustion engines and more particularly to control means for opening the choke valve after the engine is started.

In order to prevent stalling of an engine after it has been started in cold weather it is desirable to partially open the automatic choke valve which initially must be fully closed by a thermostatic device in order to provide an air-fuel mixture that is rich enough to enable the engine to start. Once started, a leaner air-fuel mixture is desirable to prevent stalling and for efficient and smooth engine operation. In order to open the choke valve it has been proposed to provide a vacuum operated device that will overpower the thermostatic device that acts to control the choke valve position in response to changes in engine temperature.

It may also be desirable to gradually open the choke valve even further to obtain a leaner air-fuel mixture in order to prevent engine loading and provide reduced exhaust emissions. Such a desirable choke control should not only provide an accurately controlled rate of opening but permit a rapid closing when the vacuum suddenly drops as when the throttle is rapidly opened and the engine accelerated. The device should not be subject to malfunction due to fuel vapors or dirt entering the device.

It is an object of the present invention to provide an improved vacuum operated choke control device in combination with a charge forming device particularly a carburetor.

A further object is to provide such a vacuum device that has a precise control of the rate of operation in order to prevent the device from opening the choke valve prematurely or too rapidly thus stalling the engine prior to proper starting thereof.

Still another object is to provide means to protect the vacuum device in the event of engine backfire.

Another object is to provide the device with means to ensure that only clean filtered air will enter the vacuum device during operation.

These and other objects and advantages will be readily apparent from the following description and accompanying drawings in which.

Figures 1, 3:
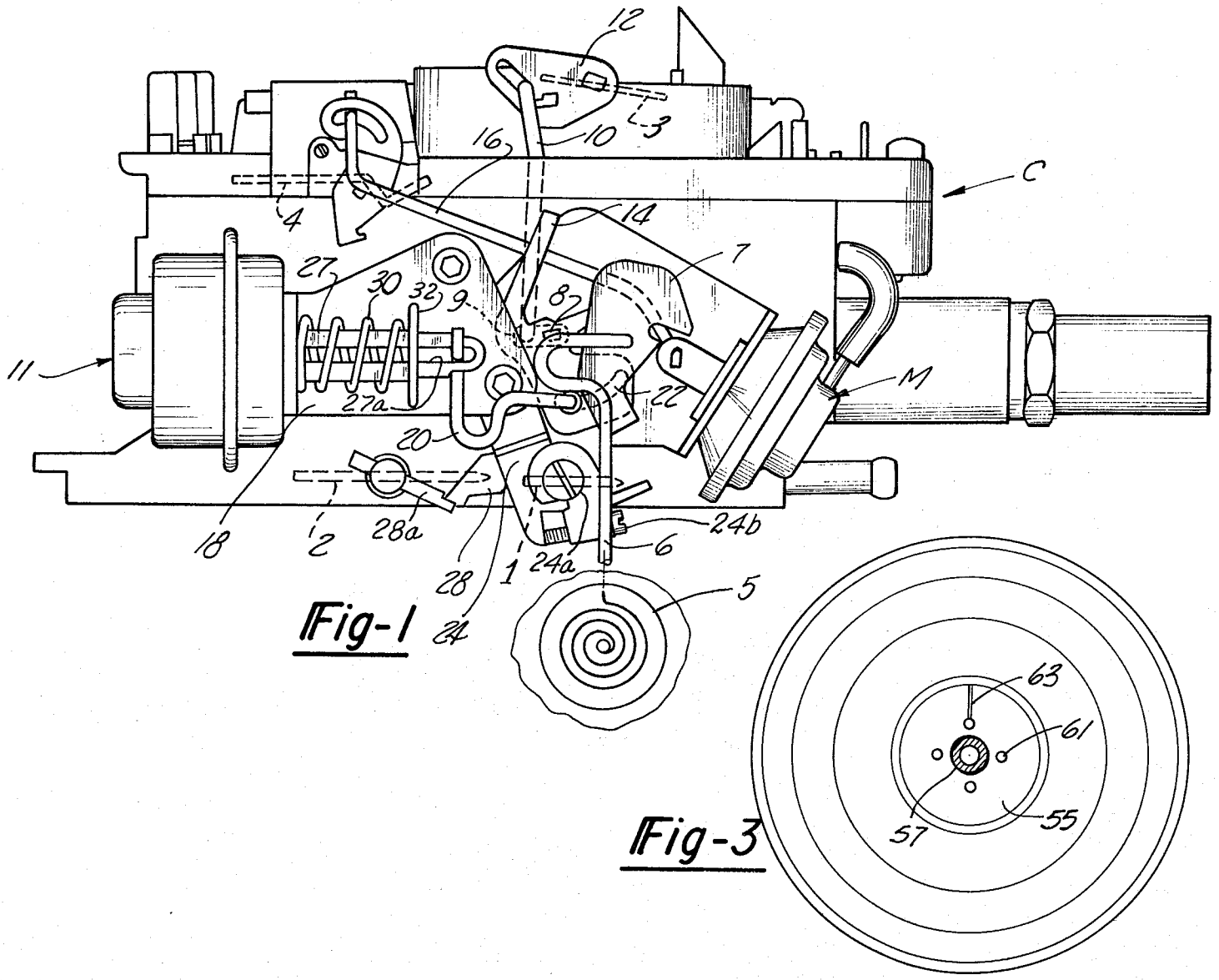
FIG. 1 is an elevational view of an engine carburetor incorporating the invention.
FIG. 3 is a cross sectional view of the vacuum operated device taken on line 3—3 in FIG. 2.

The invention is shown applied to a conventional four barrel carburetor generally indicated in FIG. 1 as C and which includes a primary throttle valve 1 and a secondary throttle valve 2 each controlling the flow of air-fuel mixture into the intake manifold of the engine. The throttle valves 1 and 2 are operated by linkage on the opposite side of the carburetor. A conventional choke valve 3 acts to restrict air flow into the primary portion and air valve 4 restricts flow into the secondary portion. The air valve is conventionally operated by air pressure differential acting on the unbalanced areas of the air valve.

A thermostatic coil device 5 acts through a rod 6 having an end portion engaging a hole in a choke control lever 7 secured to a shaft 8 pivoted in the carburetor body. Inside the carburetor housing is a lever 9 secured to the shaft 8. A choke rod 10 has one end connected to lever 9 and its other end engages a lost motion slot formed in a choke lever 12 secured to the shaft 14 on which the choke valve 3 is attached.

The choke control lever 7 has a tang portion 14 located in the path of a bent portion of a vacuum break rod 16. The rod 16 is connected at one end to a plunger extending from a primary or main vacuum diaphragm device M supported on the carburetor and at the other end, engages into a lost motion slot formed in an air valve 4 shaft lever on which the air valve is attached.

A secondary vacuum break device, generally indicated 11, is also supported on the carburetor by a bracket 18. A plunger 27 has a slot **27*a* in which one end of a secondary vacuum break rod 20 extends. The other end of the rod 20 engages in another lost motion slot 22 formed in an offset portion of the choke control lever 7. Rotatably mounted on the shaft 8 is a fast idle cam (not shown) which is actuated by another tang formed on the lever 7. A fast idle cam follower 24 is rotatable on the main throttle shaft 24*a* and an adjusting screw 24*b* adjusts the relative position of the follower and the throttle shaft. The fast idle cam has a portion that activates a secondary throttle lockout lever 28 which engages a lock pin 28*a* on the secondary throttle shaft to hold the same from being opened when the choke valve is closed. The secondary vacuum responsive break device 11 is shown in detail in FIG. 2 and comprises a casing including a pair of cup shaped members 15 and 15*a*. The members 15 and 15*a* are secured together by a flange portion 17 on member 15 rolled over the peripheral edge 19 of member 15*a*. A flexible diaphragm 21 is also secured by the clamping action of the flange portion 17.**

Figure 2:
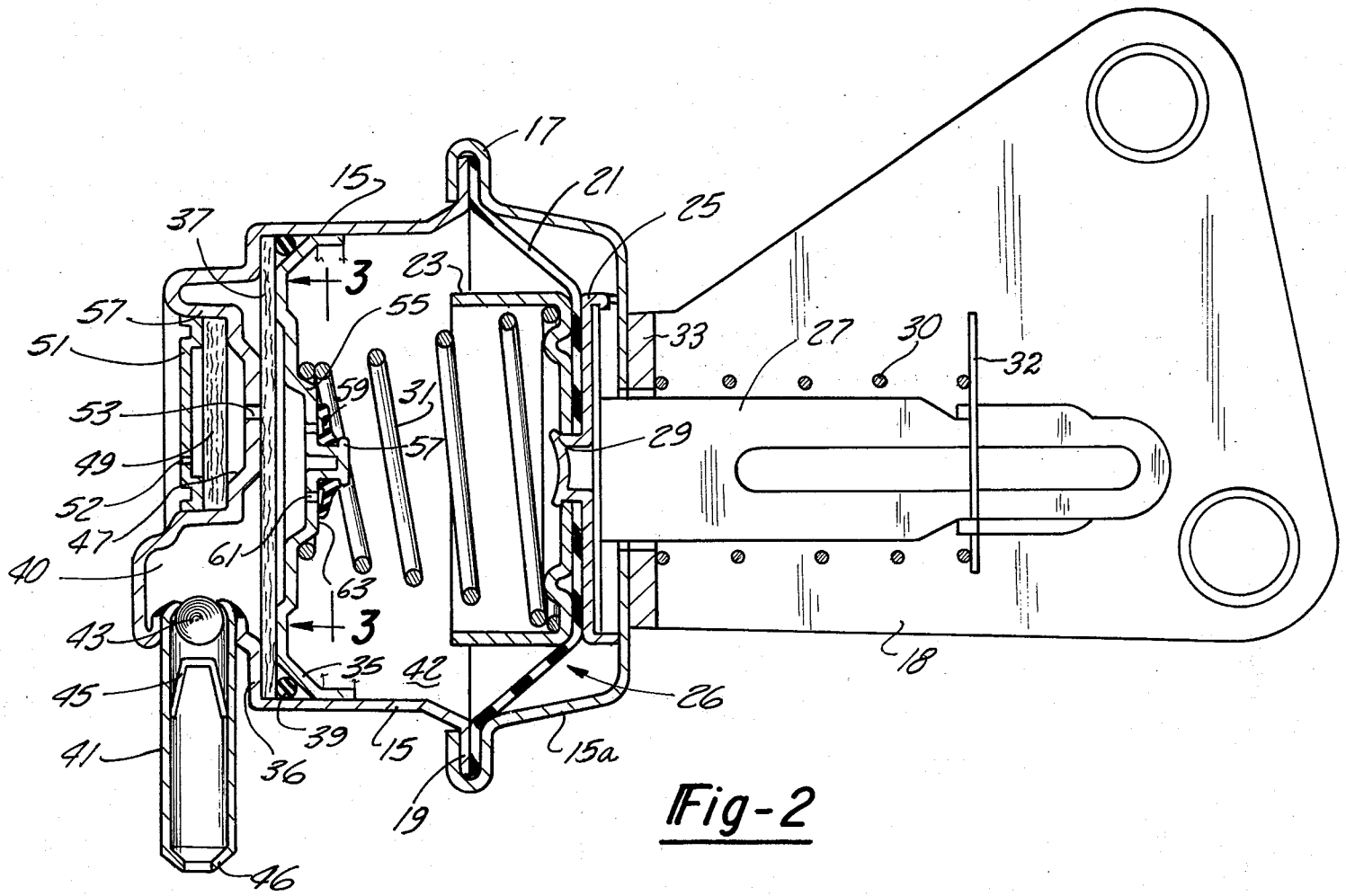
FIG. 2 is a cross-sectional view at an enlarged scale showing the vacuum operated device seen in FIG. 1.

Located at opposite sides of the diaphragm 21 are cup-shaped elements 23 and 25 which act to provide a piston like assembly 26 in combination with the diaphragm and which also act as stops to limit travel of the piston assembly. The cup elements 23 and 25 are secured together by the flattened end 29 on link 27. The piston assembly 26 is biased to the right as seen in FIG. 2 by a spring 31 engaging the piston assembly inside of cup shaped element 23. The link 27 passes through a guide 33 formed by supporting bracket 18 and through an opening in the casing member 15.

A main chamber at the left side of diaphragm 21 is divided into subchambers 40 and 42 by a rigid wall assembly which includes a cup-shaped member 35 that nests inside of the casing member 15. The wall assembly also includes a filter element 37 sandwiched between the member 35 and the radially extending end flange portion 36 of the casing member 15. An O-ring seal 39 lies between the outer peripheral edges of the filter 37 and member 35 to prevent leakage between the subchamber 40 and the subchamber 42 except through valve control means described below.

The left hand casing member 15 has an aperture into which a vacuum tube 41 is inserted. The vacuum tube carries therein a ball valve 43 that seats against the flared inner end of the tube. A spring clip retainer member 45 serves to prevent the ball valve from blocking the outer end of the tube 41 that includes an aperture 46. The tube 41 is designed to fit into a rubber tube that connects to a vacuum source, such as the intake manifold, the pressure of which varies with engine speed.

The casing member 15 has a concave portion 47 that receives a filter element 49 and a filter retaining cap 51 that has an air inlet aperture 52. The concave portion 47 has a central aperture 53. The apertures 52 and 53 permit filtered ambient air to enter the chamber 40 during movement of the piston assembly to the right by the spring 31.

The cup-shaped wall 35 serves as a valve retainer and includes an offset central portion 55 having a further offset stem portion 57 that retains a flexible disc valve 59. As seen in FIG. 3 a plurality of holes 61 are spaced around the stem 57. During movement of the piston assembly to the right as viewed in FIG. 2, air can freely enter through the holes 61 past the valve 59. During movement to the left the valve 59 closes off the holes with the exception of one hole which is connected by a narrow groove 63 formed on the surface of the offset portion 55 as seen in FIG. 3.

OPERATION

During engine cranking, the choke valve 3 is held closed by the thermostatic coil 5 acting through rod 6, lever 7, shaft 8, lever 9 and 10 and lever 12. This restricts air flow through the carburetor to provide a rich starting mixture. When the engine starts and is running, manifold vacuum is applied to the main vacuum unit M and the secondary vacuum unit 11. The main or primary unit acts by pulling in rod 16 to and move tang 14 and lever 7 sufficiently to rotate choke valve 7 clockwise and open the choke valve enough to permit the engine to run without loading or stalling.

Operation of the secondary vacuum break unit 11 is delayed due to the restricted flow of air through the slot 63. Gradually over a period of several seconds establishment of vacuum pressure in chamber 42 moves diaphragm 21 to the left and opens the choke a little further to prevent loading and provide reduced exhust emissions. This is accomplished by plunger 49 pulling rod 20 to the left to rotate lever 7 and shaft 8 clockwise.

The slot 27*a* in the stem or plunger 27 along with the slot 22 in the lever 7 permits the lever 7 to be moved between choke closed and choke open positions by the thermostatic coil unit.

The spring 30 acts between the vacuum unit 11 and a retainer 32 carried on the stem 27 to assist closing the choke when the engine is stopped and the thermostatic coil unit is cool enough to cause the choke to close.

The secondary vacuum unit 11 is operated by vacuum from any suitable source responsive to engine load and speed. This may be just below the throttle valve or in the engine manifold. The valve 43 prevents high pressure from a backfire from entering the vacuum unit to cause damage on the internal parts. This valve is not essential, but acts to protect the unit. When the engine starts the vacuum draws air from the chamber 42 through the slot 63 past the disc valve 59, through the filter 37 into chamber 40 and past the ball 43. The resulting vacuum in chamber 42 acts on diaphragm 21 to pull it to the left against the spring 31. The time for the diaphragm and connected stem 27 to stroke its full distance is normally between 1½ and 3 seconds, an optimum time to gradually open the choke the additional amount to obtain the leaner mixture that reduces emissions and at the same time prevents loading or stalling.

When the engine is stopped the vacuum in the intake manifold is gone and the spring 31 acts to move the diaphragm and stem to the right. This permits the choke valve to be set in a position totally dependent on the force of the thermostatic coil unit. As the diaphragm moves to the right, air is drawn in through aperature 52, filter 49, aperature 53, filter 37, holes 61 past valve 59 into chamber 42. This air is double filtered and acts to purge the unit of any fuel vapors and dirt which may possibly enter the check bleed valve and disrupt proper operation of the same.

Since the holes 52 and 53 always expose the chamber 40 to the atmosphere, they must be such that at least one is small enough to restrict flow enough to allow the vacuum to reach a value sufficient to operate the unit. Since clean outside air is always entering the system through the filter 49, the system is being constantly cleaned.

Modifications and changes may be apparent to those skilled in the art and such changes are deemed to be within the scope of the invention which is limited only by the following claims.

The embodiments of the invention in which an exclusive property or privilege is claimed are defined as follows:

1. A charge forming device for an internal combustion engine including an induction passage forming inlet and outlet portions, a choke valve in the passage adjacent the inlet portion, a temperature responsive element operatively connected to the choke valve and adapted to urge the valve to a closed position with a force inversely proportioned to temperature, a vacuum responsive device operatively connected to the choke valve and adapted to move the same from a closed position to a partially open position at a controlled rate in response to a predetermined vacuum at said outlet portion, said vacuum responsive device including a casing, a flexible diaphragm dividing the casing into two main chambers, resilient means urging the diaphragm and operatively connected choke valve to a closed position, a rigid wall assembly separating one of the main chambers into first and second subchambers, said rigid wall assembly including a main filter element for filtering air flow between the subchambers, at least one aperture in said rigid wall assembly, a flexible valve member movable in response to pressure differential between a closed position normally engaging said rigid wall assembly and an open position spaced from said wall to permit air flow from the first subchamber adjacent to the flexible diaphragm directly through said aperture to the second subchamber, by-pass means formed in said rigid wall assembly and communicating said aperture with said first subchamber when said valve member is in its closed position for permitting restricted fluid flow in either direction between said subchambers, and a vacuum passage adapted to connect said second subchamber with a source subject to manifold vacuum pressure at said outlet portion.

2. The charge forming device of claim 1 wherein oneway check means are provided to prevent air flow from said vacuum passage to said second subchamber to protect said device from the effects of sudden increases in pressure in said outlet portion as would occur during an engine backfire.

3. The charge forming device of claim 2 wherein said passage includes a tube member connected to said second subchamber and one-way means comprises a ball valve seating against a conical seat formed in the tube, and a ball retainer comprising a U-shaped spring clip located in said passage downstream of said ball.

4. The charge forming device of claim 1 wherein an air inlet is provided in said casing communicating with said second subchamber to permit a continuous controlled restricted rate flow of clean air into said second subchamber, said air inlet having an effective area less than said passage whereby a vacuum can be maintained in said second subchamber.

5. The charge forming device of claim 4 wherein a second filter element is provided to filter air passing through said air inlet means, to said second subchamber said casing having a concave portion in which said air inlet is provided and in which said filter element is held.

6. The charge forming device of claim 1 wherein said by-pass means comprises a groove formed in the surface of the rigid assembly under said flexible valve member.

7. The charge forming device of claim 1 wherein said rigid wall assembly comprises a cup-shaped element in said casing engaging said main filter element and holding the same in position against the casing, and a seal member between the periphery of the cup-shaped element and the casing preventing leakage between the two subchambers.

8. The charge forming device of claim 7 wherein said cup-shaped member has a central circular offset portion, said aperture located in said offset portion, said flexible valve member having a central retaining hole, said central offset portion having a valve retaining stem portion extending through said hole and said flexible valve member in position against said offset portion, said by-pass groove extending along the surface of the offset portion from the outer edge thereof to said aperture to permit a controlled two-way flow of air between said chambers through said groove and aperture.

9. The charge forming device of claim 7 wherein said cup-shaped member comprises a continuous member having an axially extending outer periphery portion engaging the inner side of said casing, an angular annular portion engaging said seal member, a radially extending annular portion engaging said main filter element, a first axially offset radially extending annular portion spaced from said main filter element and engaging said resilient means, a second axially offset radially extending annular portion forming a seat for the flexible valve member and a third centrally located axially extending portion having an enlarged valve retaining end, said second axially extending offset portion including said aperture and wherein said by-pass means comprises a groove formed in the surface of the second offset portion and extending from the edge thereof to the aperture and wherein said second offset portion serves as a seat for said resilient means.

10. A vacuum responsive device adapted to be operatively connected to a choke valve of a charge forming device for an internal combustion engine, said device including a casing, a flexible diaphragm in said casing and forming two chambers therein, a spring member urging said diaphragm in one direction, a passage means connected to said casing and adapted to connect the casing and one side of the diaphragm to a source of engine manifold vacuum, a rate control valve assembly in the casing for controlling the rate of air movement between said passage and one of said chambers, said valve assembly including an axially extending outer periphery portion engaging the inner side of said casing, an annular portion engaging said main filter element, a first axially offset radially extending annular portion spaced from said main filter element and engaging said spring member, a second axially offset radially extending annular portion forming a seat for a flexible valve member having a central hole therein and a third centrally located axially extending portion having an enlarged valve retaining end, said second axially extending offset portion including an aperature, by-pass means comprising a groove formed in the surface of the second offset portion and extending from the edge thereof to the aperature, said second offset portion serving as a seat for said spring member.

11. A charge forming device for an internal combustion engine including an induction passage forming inlet and outlet portions, a choke valve in the passage adjacent the inlet portion, a temperature responsive element operatively connected to the choke valve and adapted to urge the valve to a closed position with a force inversely proportioned to temperature, a vacuum responsive device operatively connected to the choke valve and adapted to move the same from a closed position to a partially open position at a controlled rate in response to a predetermined vacuum at said outlet portion, said vacuum responsive device including a casing, a flexible diaphragm dividing the casing into two main chambers, resilient means urging the diaphragm and operatively connected choke valve to a closed position, a rigid wall assembly separating one of the main chambers into first and second subchambers, said rigid wall assembly including a main filter element for filtering air flow between the subchambers, at least one aperture in said rigid wall assembly, a flexible valve member normally engaging said rigid wall assembly and closing said aperture against air flow from the first subchamber adjacent to the flexible diaphragm to the second subchamber, bypass means formed in said rigid wall assembly permitting restricted fluid flow in either direction between said subchambers, a vacuum passage adapted to connect said second subchamber with a source subject to manifold vacuum pressure at said outlet protion, and a second vacuum responsive device initially opening said choke valve a predetermined amount upon starting of the engine, said first mentioned vacuum responsive device acting to open said check valve an additional amount during a predetermined range of time.

12. The charge forming device of claim 11 wherein oneway check means are provided to prevent air flow from said vacuum passage to said second subchamber to protect said device from the effects of sudden increases in pressure in said outlet portion as would occur during an engine backfire.

13. The charge forming device of claim 11 wherein an air inlet is provided in said casing communicating with said second subchamber to permit a continuous controlled restricted flow of clean air into said second subchamber, said air inlet having an effective area less than said passage whereby a vacuum can be maintained in said subchamber.

14. The charge forming device of claim 11 wherein said bypass means comprises a groove formed in the surface of the rigid assembly under said flexible valve member.

15. A charge forming device for an internal combustion engine including an induction passage forming inlet and outlet portions, a choke valve in the passage adjacent the inlet portion, a temperature responsive element operatively connected to the choke valve and adapted to urge the valve to a closed position with a force inversely proportioned to temperature, a vacuum responsive device operatively connected to the choke valve and adapted to move the same from a closed position to a partially open position at a controlled rate in response to a predetermined vacuum at said outlet portion, said vacuum responsive device including a casing, a flexible diaphragm dividing the casing into two main chambers, resilient means urging the diaphragm and operatively connected choke valve to a closed position, a rigid wall assembly separating one of the main chambers into first and second subchambers, said rigid wall assembly including a main filter element for filtering air flow between the subchambers, a cup-shaped element engaging and holding said filter element in position against said casing, said cup-shaped member having a central offset portion, an aperture in said offset portion, a flexible valve member normally engaging said rigid wall assembly and closing said aperture against air flow from the first subchamber adjacent to the flexible diaphragm to the second subchamber, said flexible member having a central retaining hole, said central offset portion having a valve retaining stem portion extending through said hole and to hold said flexible valve member in position against said offset portion, a by-pass groove formed in said rigid wall assembly and extending along the surface of the offset portion from the outer edge thereof to said aperture to permit a controlled two way flow of air between said subchambers through said groove and aperture and a vacuum passage adapted for connection to a source of manifold vacuum pressure.

16. The charge forming device of claim 15 wherein said cup-shaped member comprises a continuous member having an axially extending outer periphery portion engaging the inner side of said casing, an angular annular portion engaging said seal member, a radially extending annular portion engaging said main filter element, said offset portion including a first axially offset radially extending annular portion spaced from said main filter element and engaging said resilient means, a second axially offset radially extending annular portion forming a seat for the flexible valve member and a third centrally located axially extending portion having an enlarged valve retaining end, said second axially extending offset portion including said aperture and said groove being formed in the surface of the second offset portion and extending from the edge thereof to the aperture.

* * * * *

UNITED STATES PATENT OFFICE

CERTIFICATE OF CORRECTION

Patent No. 3,991,731 Dated November 16, 1976

Inventor(s) Benjamin C. Benjamin

It is certified that error appears in the above-identified patent and that said Letters Patent are hereby corrected as shown below:

Abstract, line 2, "thermoplastic" should be --thermostatic--.

Column 3, line 28, after "to" insert --engage--.

Column 3, line 37, "exhust" should be --exhaust--.

Signed and Sealed this

Fifth Day of April 1977

[SEAL]

*Attest:*

RUTH C. MASON
*Attesting Officer*

C. MARSHALL DANN
*Commissioner of Patents and Trademarks*